United States Patent [19]

McCullough, Jr. et al.

[11] Patent Number: 4,957,807

[45] Date of Patent: Sep. 18, 1990

[54] NONLINEAR AROMATIC POLYAMIDE FIBER OR FIBER ASSEMBLY

[75] Inventors: Francis P. McCullough, Jr., Lake Jackson, Tex.; Bhuvenesh C. Goswami, Clemson, S.C.; R. Vernon Snelgrove, Damon, Tex.; David M. Hall, Auburn, Ala.

[73] Assignee: The Dow Chemical Company, Midland, Mich.

[21] Appl. No.: 439,300

[22] Filed: Nov. 21, 1989

Related U.S. Application Data

[63] Continuation-in-part of Ser. No. 278,084, Nov. 30, 1988, abandoned, and a continuation-in-part of Ser. No. 278,081, Nov. 30, 1988.

[51] Int. Cl.[5] ..... D02G 3/00

[52] U.S. Cl. ..... 428/222; 428/221; 428/224; 428/292; 428/362; 428/364; 428/367; 428/369; 428/371; 428/373; 428/408

[58] Field of Search ..... 428/364, 369, 371, 224, 428/222, 362, 292, 280, 373, 221, 408; 423/447.1, 447.2

[56] References Cited

U.S. PATENT DOCUMENTS

| | | | |
|---|---|---|---|
| 4,143,197 | 3/1979 | Jasionowicz et al. | 428/474.7 X |
| 4,143,384 | 3/1979 | Jasionowicz et al. . | |
| 4,401,588 | 8/1983 | Turner | 423/447.2 X |
| 4,482,603 | 11/1984 | Yoshida et al. | 428/287 |
| 4,525,384 | 6/1985 | Aoki et al. | 427/174 |
| 4,642,664 | 2/1987 | Goldberg et al. | 423/447.2 |
| 4,723,959 | 2/1988 | Miyamichi et al. | 427/227 X |
| 4,752,514 | 6/1988 | Windley . | |
| 4,857,404 | 8/1989 | McCullough, Jr. | 428/369 X |

OTHER PUBLICATIONS

PCT WO86/06110 by McCullough et al, published Oct. 23, 1986, "Carbonaceous Fibers with Spring-Like Reversible Deflection and Method of Manufacture".

*Primary Examiner*—Lorraine T. Kendell

[57] ABSTRACT

The invention resides in a nonlinear heat set aromatic polyamide fiber having a reversible deflection of greater than 1.2:1 at ambient temperatures, an aspect ratio of greater than 10:1, and a bending strain value less than 50%, and the method of preparing said fiber.

16 Claims, 6 Drawing Sheets

NONLINEAR AROMATIC POLYAMIDE FIBER OR FIBER ASSEMBLY

RELATED APPLICATION

This application is a continuation-in-part of application Ser. No. 278,084 filed Nov. 30, 1988, now abandoned and application Ser. No. 278,081 filed Nov. 30, 1988, of McCullough et al.

1. Field of the Invention

The invention resides in nonlinear aromatic polyamide fibers. The fibers comprise aromatic polyamide precursor fibers having imparted thereto a nonlinear configuration capable of reversible deflection at ambient temperature of greater than about 1.2 times the length of the nonlinear fibers and which possess a percent bending strain value of less than 50. The fibers also posses improved tenacity over mechanically crimped fibers.

2. Background of the Invention

The prior art discloses the manufacture of fibers from polymeric compositions such as polyacrylonitrile (PAN) by the conventional technique of spinning the fibers which can then be collected into multifiber assemblies, such as tows, and can thereafter be oxidatively stabilized. Such fibers may then subjected to a carbonizing procedure to provide the fiber with a nonlinear configuration.

The prior art generally discloses linear aromatic polyamide fibers having a high tensile strength. To provide such fibers with a "graphitic" nature, has necessitated the utilization of elevated temperatures to obtain a high degree of carbonization. However, the fibers produced from such a high temperature treatment are very brittle and incapable of standing up to strain such as a repeated bending of the fibers, particularly when they have been subjected to a temperature above about 700° C.

U.S. Pat. No. 4,120,914 discloses the preparation of highly crimped fibers of poly(p-phenylene terephthalamide) which, as a result of the crimping, suffer mechanical damage resulting in an appreciable decrease in fiber tenacity. The crimping is performed by a steam stuffer-box crimping mechanism.

Stuffer box crimping results in sharp V-type bends in the outer portion of the bend and severe compression on the underside of the bend. These sharp bends therefore provide severely weakened portions in the fiber by causing fibrillation and increase in the bending strain, leading to unacceptable fiber breakage, especially with fibers that are rigid or stiff or subsequently heat treated.

In an article by Hall et al entitled, "Effects of Excessive Crimp on the Textile Strength and Compressive Properties of Polyester Fibers, in *Journal of Applied Polymer Science*, Vol. 15, pp. 1539–2544 (1971), there is described the effect of forming sharp crimps in polyester fibers as well as other man-made fibers. Excessive crimping, such as is found in V-type crimps, leads to surface damage of the fiber and a reduction in tenacity and elongated properties, i.e., fiber breakage when the fiber is placed under tension.

U.S. Pat. No. 4,752,514 to Windley, which is herewith incorporated by reference, shows photographs of the damage to aromatic polyamide fibers which results from stuffer box crimping.

U.S. Pat. No. 4,401,588 to Turner discloses a process for making an active carbon fabric from an aramid fabric by heating the fabric to a temperature of from 850° C. to 950° C. in an inert atmosphere.

U.S. Pat. No. 3,560,135 to Han discloses that heating mechanically crimped aromatic polyamide fibers to a temperature range of from 257° C. to 400° C. for 1 to 10 minutes increases their hydrolytic durability and solvent resistance. However, there is a loss in tenacity, as a result of the crimping and the presence of fibrils.

U.S. Pat. No. 4,193,252 to Sheppherd et al. discloses the making of partially carbonized, graphite and carbon fibers from stabilized rayon which have been knitted into a fabric. When the fabric is deknitted, the partially carbonized and the carbonized fibers contain kinks. The fully carbonized or graphite fibers have kinks which are more permanent in nature. It has been found, however, that partially carbonized rayon fibers are flammable, easily break under tension, do not retain their reversible deflection and lose their kinks at relatively low temperatures or under tension.

U.S. Pat. No. 4,642,664 of Goldberg et al. discloses the use of partially carbonized aromatic polyamides for use as conductors in electrical devices. However, only linear fibers that have been heat treated over 400° C. are disclosed in the patent.

European Pat. Publication Ser. No. 0199567, published Oct. 29, 1986, entitled, "Carbonaceous Fibers with Spring-Like Reversible Deflection and Method of Manufacture," by McCullough et al, discloses nonlinear carbonaceous fibers derived from polymeric precursor fibers such as polyacrylonitrile which may be utilized to form fiber blends with the crimped fibers of this invention.

The fibers of the invention are distinguishable over the carbonaceous fibers derived from polyacrylonitrile based fibers by possessing greater relative strength and abrasion resistance. Also, the polyamide fibers such as p-aramid are liquid crystals.

The term "uniform diameter" when used herein relates to the diameter of the fiber as drawn prior to crimping. The fiber may contain the slight variations which are common during normal fiber processing operations.

The term "bending strain" as used herein is as defined in *Physical Properties of Textile Fibres*. W. E. Morton and J. W. S. Hearle, The Textile Institute, Manchester, 1975, pages 407–409. Accordingly, the percent bending strain on the fiber can be determined by the equation:

$$S = \frac{r}{R} \times 100$$

where S is the percent (%) bending strain, r is the fiber radius and R is the radius of curvature of bend. That is, if the neutral plane remains in the center of the fiber, the maximum percentage tensile strain, which will be positive on the outside and negative on the inside of the bend, equals $r/R \times 100$ in a circular cross section of the fiber.

The term "carbonaceous fiber" is understood to mean that the carbon content of the original aromatic polyamide fiber has been increased as a result of an irreversible chemical reaction caused by heat treatment.

It is understood that the aromatic polyamide fiber can be heat treated at elevated temperatures for a period of time that the carbon content can be increased slight, that is, partially carbonized to complete carbonization as disclosed in U.S. Pat. No. 4,642,664.

The term "reversible deflection" or "working deflection" as used herein applies to a helical or sinusoidal compression spring. Particular reference is made to the publication, "*Mechanical Design—Theory and Practice,*" MacMillan Pub. Co., 1975, pp. 719 to 748; particularly Section 14-2, pages 721 to 724.

The terms "permanent" or "irreversibly heat set at ambient temperature" used herein applies to nonlinear aromatic polyamide fibers which have been treated under the conditions as set forth hereinafter until they possess a degree of resiliency and flexibility such that the fibers, when stretched and placed under tension to a substantially linear shape but without exceeding the tensile strength of the fibers, will revert substantially to their original nonlinear shape once the tension on the fibers is released. The foregoing terms also imply that the fibers can be stretched and released over many cycles without breaking the fibers.

The term "fiber structure" herein applies to a fiber tow comprising a multiplicity of filaments, a yarn, a multiplicity of entangled nonlinear aromatic polyamide fibers forming a shape reforming wool-like fluff, a batting, webbing or felt of nonwoven fibers, a knitted or woven cloth or fabric, or the like. More particularly, the fiber structure of the present invention, particularly when in the shape of a wool-like fluff, is lightweight, resilient, and compressible. The fluff, at ambient temperature, has good shape and volume retention and is stable to numerous compression and unloading cycles without breakage of the fibers.

The term "crimp" as utilized herein refers to the prior art kinks produced on the fiber and the non-linear portion produced on the fiber, tow, or the like of the invention and includes the different configurations such as sinusoidal, coil-like, etc.

"Pseudoextensibility" is the elongation which results from the non-linear configuration and/or false twist imposed on the fiber.

KEVLAR-29 (a Trademark of E. I. duPont de Nemours & Co.) is a p-aramid with high tensile strength (2.758 G.Pa, 400,000 psi) but moderate modulus (62 G. Pa, $9\times10^6$ psi) and an elongation to break of 4.0 %.

KEVLAR-49 (a Trademark of E.I. duPont de Nemours & Co.) is a p-aramid with the same tensile strength as KEVLAR-29 but higher modulus (124 G.Pa, $18\times10^8$ psi) with an elongation to break of 2.5%.

SUMMARY OF INVENTION

It has now been found that aromatic polyamide fibers can be provided with crimps without a substantial loss in mechanical properties and thus providing a novel fiber structure having new and unexpected properties and capabilities. In addition, heat treated and crimped aromatic polyamide fibers have provided superior loft and compression in the form of a fluff than mechanically crimped non-heat treated fibers.

The process of the invention provides aromatic polyamide fibers, such as p-aramid with at least a pseudoextensibility which is necessary for processing the fibers into a fabric. The resultant non-linear fiber provides a yarn with improved loft, bulkiness and friction without creating weak spots as occurs by mechanical crimping.

In accordance with the present invention there is provided a novel aromatic polyamide fiber having a non-linear configuration with a reversible deflection ratio of greater than 12: at ambient temperatures, an aspect ratio (length/diameter (l/d)) of greater than 10:1, and a bending strain value less than bout 50%. The novel fiber has improved tenacity over mechanically crimped fibers.

Advantageously, the crimped portion of the fiber does not have more than a 15 percent variation from normal fiber diameter, preferably not more than 5%. Under ideal conditions the crimp portion is substantially free of any variations.

The preferred fibers of the invention possess a tenacity of at least about 18 g/dn and/or maintain their nonlinearity at temperatures in excess of 100° C.

Advantageously, the fibers of the invention are substantially free of variations in fiber diameter, possess a strain value not more than 50%, preferably less than 30%, and the crimp or non-linear portions are substantially free of fibrils.

The fibers of the present invention provide an improvement over aromatic polyamide fibers which have had a crimp imparted to them by gear crimping or stuffer box crimping techniques of the prior art. The prior art techniques generally result in fibrillation, and/or other damage at the sites of crimp and a substantial variation of fiber diameter. These factors result in a weakening of the overall fiber and effect the performance of the fiber in processing and when placed in an environment of repeated bends. The loss of fiber properties becomes more pronounced when the weakened fibers are subsequently heat treated.

It has also been discovered that the prior art fibers are further weakened with a bending strain value of greater than 50%. If attempts are made to decrease the bending strain value by mechanical crimping with rounded crimps, there is a corresponding loss in the reversible deflection ratio. Gear crimping with flat gears usually results in a bending strain value of about 80%.

In accordance with one embodiment, the fibers of the invention are prepared from a stabilized or non-stabilized aromatic polyamide fiber precursor material.

In accordance with another embodiment of the invention the crimped fibers of the invention are blended with the polyacrylonitrile based carbonaceous fibers of U.S. Pat. No. 4,869,951, which is incorporated herein by reference. The combination of carbonaceous fibers and non-linear polyamide fibers in yarn permits the manufacture of fabrics which are resistant to chemical attack, which possesses good abrasive strength and a loft which permits the permeation of air.

It has been found that the crimp characteristics can be better controlled according to the present invention than with the use of gear crimping techniques or stuffer box crimping particularly with fibers of greater diameters or larger fiber tows.

DESCRIPTION THE PREFERRED EMBODIMENTS

Figure 1:
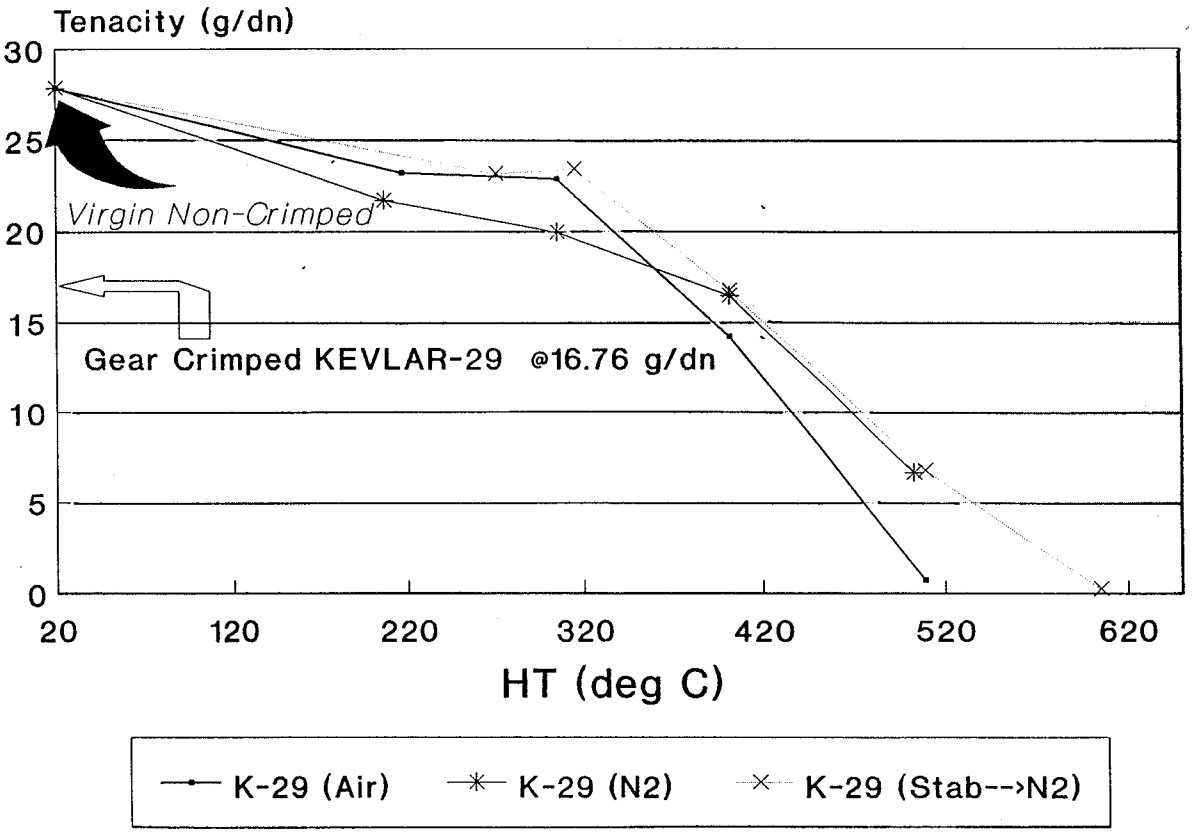
FIG. 1 is a graph illustrating the improvement in tenacity and elongation of KEVLAR-29 when treated according to the invention.

According to the invention, aromatic polyamide fibers are formed into a non-linear configuration having a substantially uniform diameter along its length by heating a precursor fiber, preferably, without any tension or stress at elevated temperatures so as to set a non-linear configuration with a strain value of less than 50% that is free of fibrils. The precursor fiber may also be oxidation stabilized by heat treatment at elevated temperatures in air.

It is preferable to simultaneously heat treat the fibers and to provide the non-linear configuration. Advantageously, the heat setting is in a water-free inert atmosphere.

Specific examples of aromatic polyamides include polyparabenzamide and polyparaphenylene terephthalamide. Polyparabenzamide and their processes of preparation are disclosed in U.S. Pat. Nos. 3,109,836; 3,225,011; 3,541,056; 3,542,719; 3,547,895; 3,558,571; 3,575,933; 3,600,350; 3,671,542; 3,699,085; 3,753,957; and 4,025,494. Polyparaphenylene terephthalamide (p-aramid) is available commercially as KEVLAR, a trademark of E. I. duPont de Nemours, and processes of preparing the same are disclosed in U.S. Pat. Nos. 3,006,99; 3,063,966; 3,094,511; 3,232,910; 3,414,645; 3,673,143; 3,748,299; 3,836,498; 3,827,988, among others. Other wholly aromatic polyamides are poly(2,7-phenanthridone)terephthalamide, poly(paraphenylene-2, 6-naphthalamide), poly(methyl-1,4-phenylene) terephthalamide. Additional specific examples of wholly aromatic polyamides are disclosed by P. W. Morgan in "Macromolecules," Vol. 10, No. 6, pp. 1381–90 (1977).

The aromatic polyamide fibers of the invention are provided with a nonlinear configuration when heated in a coiled or crimped state at a temperature above 200° C., preferably at a temperature of from 200° C. to 550° C., and more preferably from 220° C. to 375° C. in a water free atmosphere. The period of heating time depends on the temperature, size of fiber, type of aromatic polyamide etc. A more permanent heat set is imparted when the fibers are heated at higher temperatures and when made carbonaceous.

Stabilized or nonstabilized aromatic polyamide fibers which are provided with a nonlinear configuration when heat treated in an unstressed and in a coiled or crimped state, in an inert atmosphere result in a stronger fiber with a more permanent crimp than those fibers heat treated in air.

Preferably, the fibers are free of any V-type that cause a strain value greater than 50% which may weaken the fibers.

More particularly, the invention resides in nonlinear, resilient, aromatic polyamide fiber having a reversible deflection ratio of greater than about 1.2:1 at ambient temperatures, an aspect ratio (1/d) of greater than 10:1, and improved tenacity over mechanically crimped fibers. The fibers may be carbonaceous or noncarbonaceous and preferably have a uniform diameter and a sinusoidal or a coil-like configuration or a more complicated structural combination of the two.

The fibers are typically formed by conventional methods into a fiber having a normal nominal diameter of from 4 to 25 microns. The fiber is collected as an assembly of a multiplicity of continuous fibers in tows. The tows may then be stabilized in the conventional manner such as described in U.S. Pat. No. 4,642,664. The tows (or staple yarn made from chopped or stretch broken fiber staple) are thereafter formed into a substantially uniform coil-like and/or sinusoidal form by knitting or weaving the tow or yarn into a fabric or cloth. The so-formed knitted fabric or cloth is thereafter heat treated at the hereinbefore stated temperatures, in an inert atmosphere or in air for a period of time to result in an irreversible internal modification of the fiber structure to be irreversibly heat set at ambient temperature in a nonlinear configuration. It is of course to be understood that the precursor fibers may be initially crimped and then heat treated. It is advantageous that the heat treatment be conducted while the nonlinear fibers are in a relaxed or unstressed state. Greater improvement in physical properties are found with fibers which are simultaneously crimped according to the invention and heat treated particularly in a water free atmosphere.

As a result of the heat treatment, a coil-like or sinusoidal configuration or structure is imparted to the fiber, tow or yarn (in the knitted cloth or fabric) which is permanent at ambient temperatures. The resulting fiber, tow or yarn having the nonlinear structural configuration is deknitted, and the deknitted fiber, tow or yarn, or even the cloth per se, may then be subjected to other methods of treatment known in the art, such as garnetting (to create an opening), a procedure in which the fibers, yarn, tow, or the cloth per se, are separated into an entangled mass of a multiplicity of fibers in the form of a woollike fluffy material wherein the individual fibers retain their coil-like or sinusoidal configuration yielding a shape reforming mass of the entangled fibers of considerable loft.

The fibers when heat set in accordance with the present invention into the desired nonlinear structural configuration retain their resilient and reversible deflection characteristics up to a temperature of at least 100° C.

It was generally found that fibers heat treated between 525° to 625° C., for example 2 to 3 minutes, had an increase of carbon content from about 70.6% to about 75%. These fibers were non-graphitic and carbonaceous.

The fibers of the invention can be blended with other synthetic or natural fibers, especially non-graphitic carbonaceous fibers when forming fabrics, particularly protective fabrics. Advantageously, the other fibers are used in an amount of up to 90 percent by weight based on the total weight of the fibers, so as to obtain materials having enhanced abrasion resistance similar to Kevlar and the handle of the other fibers. These features make the blends especially useful when the fibers are used in protective clothing.

The non-linear feature and improved tenacity of the fibers and fiber blends permits improved manufacture and end product since there are fewer fiber breaks and the crimp provides loft to the fabrics. The heat treatment together with the crimp improves the compressibility of the fibers in the form of a batting.

It is to be further understood that, if desired, the fibers may have imparted to them an electrically conductive property by heating the fibers, or fiber structure, to a temperature above 700° C. in a nonoxidizing atmosphere as described in the aforementioned U.S. Pat. No. 4,642,664 so as to result in a crimped graphitic fiber.

Figure 2A:
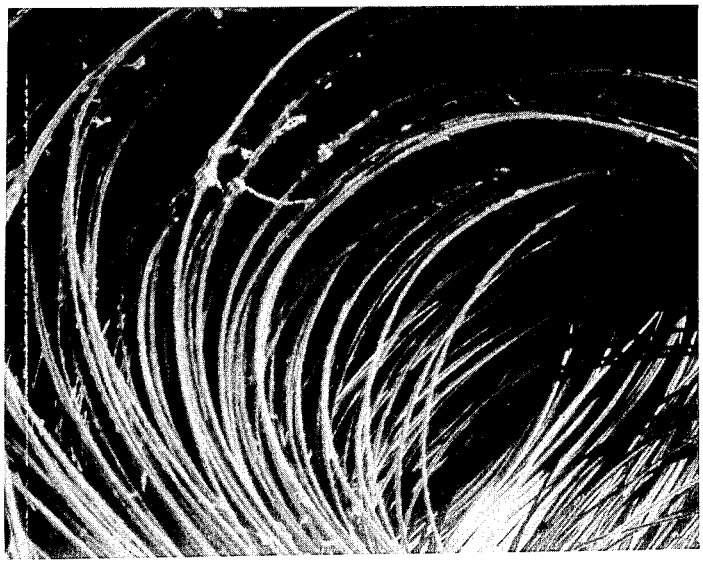
FIG. 2A shows a micrograph of KEVLAR-29 at 75 times magnification, which has been made non-linear by heat treatment in air for 10 minutes to 300° C.
Figure 2B:
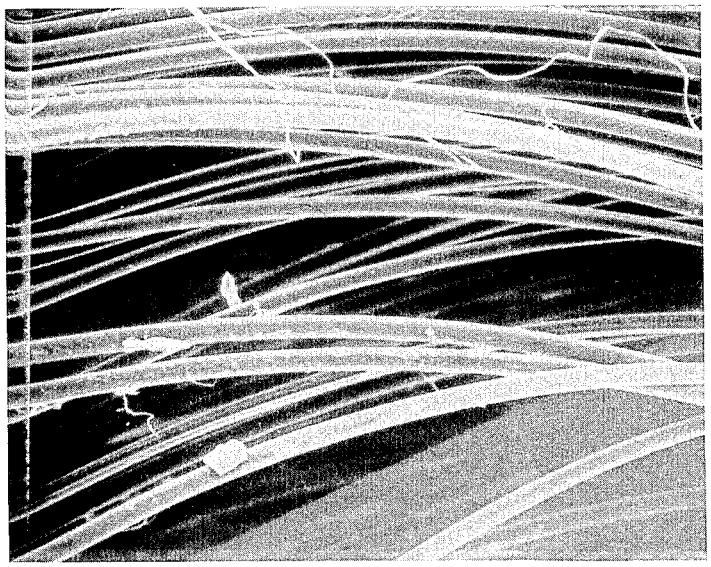
FIG. 2B shows a micrograph of the fibers of FIG. 2A at a magnification of 350 times.

The process of the present invention results in nonlinear aromatic polyamide fibers which are free of many defects which weaken the fibers. It has been found that gear crimping of aromatic polyamide fibers results in damage to the fibers which is more pronounced when the fibers are subsequently heat treated. As seen in FIGS. 2A and 2B, KEVLAR-29 which was made nonlinear according to the invention by heat treatment in air to 300° C. for 10 minutes and are substantially uniform, free of fibrils and distortions.

Figure 2C:
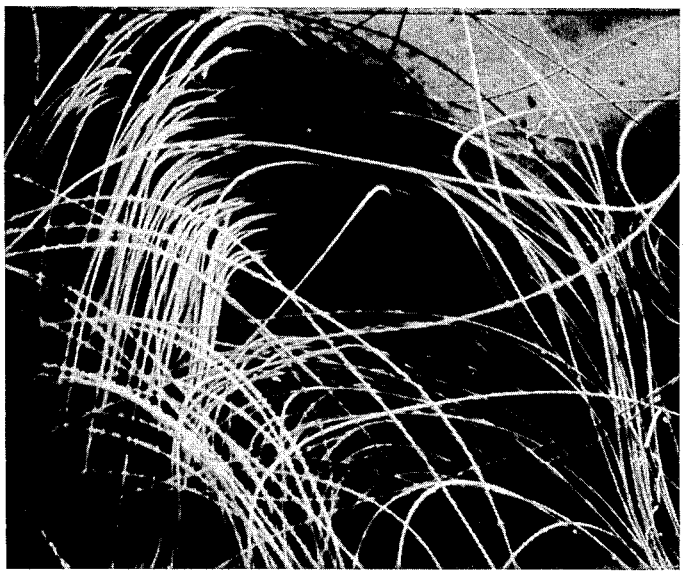
FIG. 2C shows a micrograph of KEVLAR-29 at 50 times magnification which has been made non-linear by heat treatment in air for 10 minutes to 500° C.
Figure 2D:
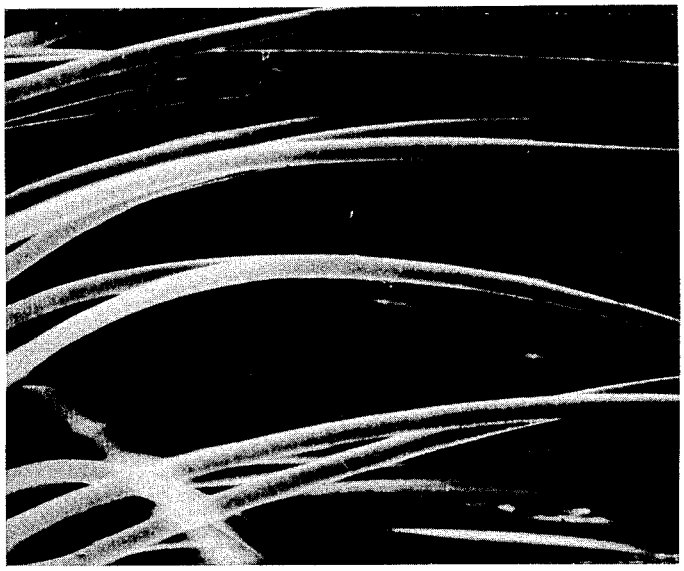
FIG. 2D shows a micrograph of the fibers of FIG. 2C at a magnification of 400 times.

FIGS. 2C and 2D shows KEVLAR-29 fibers of the invention which were heat treated in air at a temperature of 500° C. in air to 10 minutes. These fibers are carbonaceous and are free of fibrils and distortions.

Figure 3:
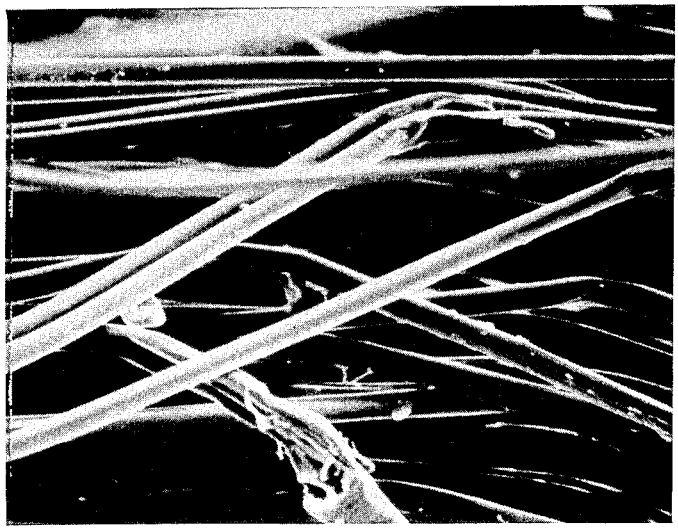
FIG. 3A shows a micrograph of KEVLAR-29 fibers which have been gear crimped at a magnification of 500 times.
FIG. 3B is a micrograph of the crimped fibers of FIGS. 3A and 3B at 75 times magnification after they have been heat treated in air for 10 minutes to 300° C.

FIGS. 3A and 3B show fibers of KEVLAR-29 which have been slightly gear crimped and not heat treated. As seen in FIG. 3A, the fibers experience a bending strain greater than 50%. As shown in FIG. 3B, the fibers as a result of gear crimping become flattened and distorted.

Figure 4:
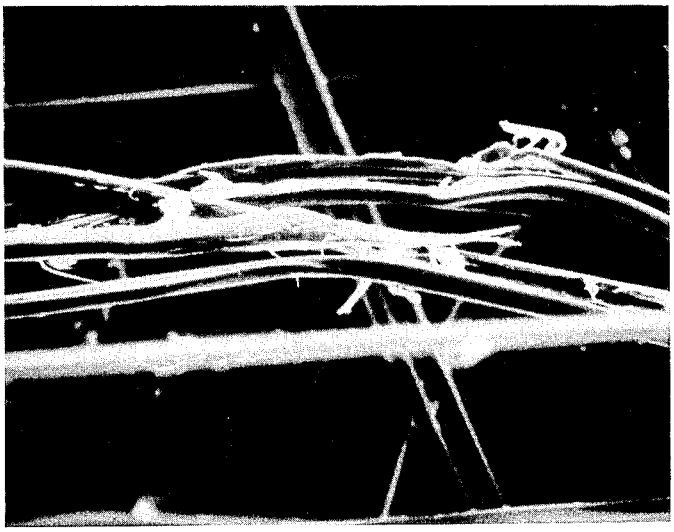
FIG. 4A is a micrograph at 400 times magnification of the fibers of FIG. 3A and 3B which have been heat treated in air to 300° C. for 10 minutes.

In FIGS. 4A and 4B the fibers of FIGS. 3A and 3B have been gear crimped at a higher pressure. It can be seen that the fiber distortion and fibrillation is more pronounced with greater crimping pressure.

Figure 5A:
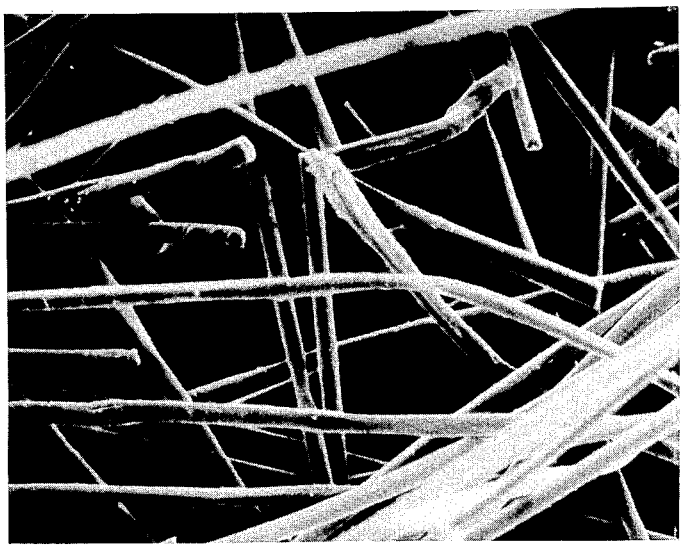
FIG. 5A is a micrograph at 100 times magnification of the fibers of FIG. 3A and 3B which have been heat treated in air to 500° C. for ten minutes.
Figure 5B:
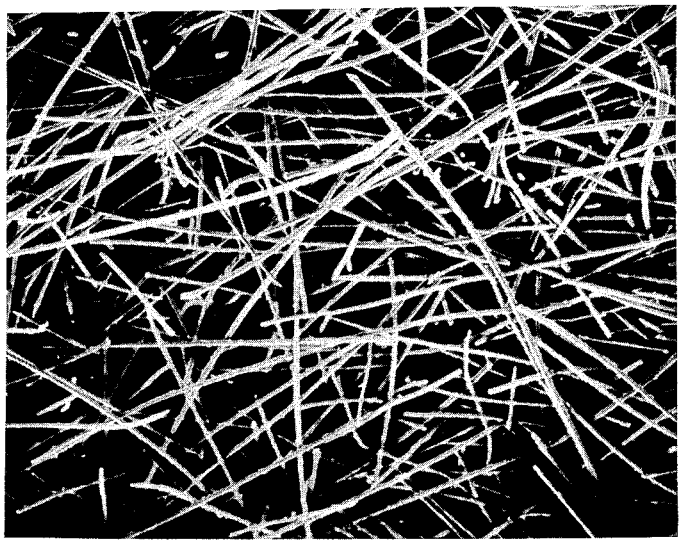
FIG. 5B is a micrograph at 400 times magnification of the fibers of FIG. 5A.

FIGS. 5A and 5B show the fibers of FIGS. 3A and 3B after heat treatment in air at 300° C. to 10 minutes. It can be seen that the heat treatment causes the fibers which were weakened by gear crimping to undergo further damage.

Figure 6A:
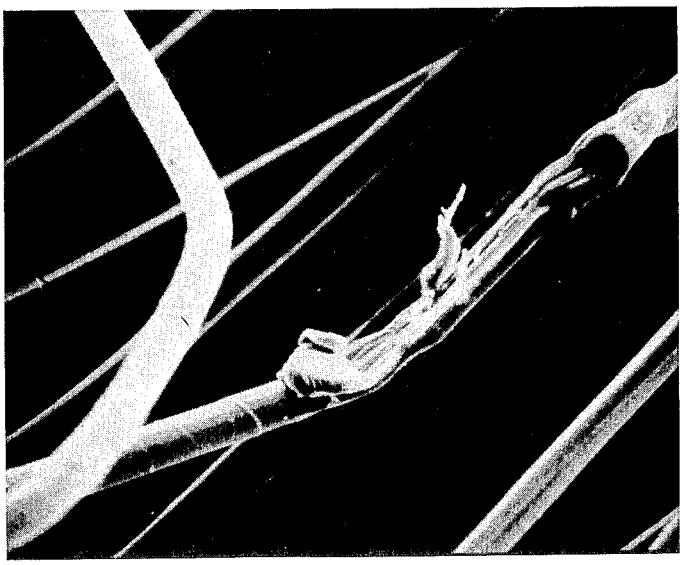
FIG. 6A is a micrograph at 600 times magnification of a gear crimped aromatic polyamide.
Figure 6B:
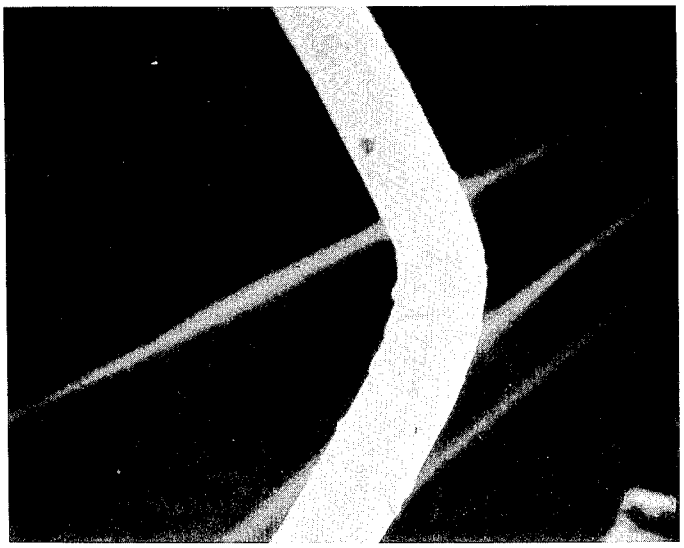
FIG. 6B is a micrograph at 1500 times magnification of the fibers of FIG. 5A.

FIGS. 6A and 6B show the fibers of FIGS. 3A and 3B after they have been made carbonaceous by heat treatment in air at 500° C. The fibers were damaged to the extent that there was no significant tenacity. The fibers were distorted and could not be handled because of fiber damage.

FIGS. 7A and 7B show the fibers of FIGS. 4A and 4B after they have been heat treated in air at 300° C. to 10 minutes. The fibers showed greater damage at the bend as a result of the heat treatment and further fibrillation. The fibers are flattened and many are broken.

FIGS. 8A and 8B show the fibers of FIGS. 4A and 4B after they have been made carbonaceous by heat treatment in air at 500° C. to 10 minutes. There is significant distortion in the fibers and complete breakage as well as a loss of tenacity.

FIGS. 9A and 9B illustrate that gear crimped aromatic polyamides undergo a bending strain greater than 50% and possess a V-shaped bend. FIG. 9B shows the compression ridges which form as a result of gear crimping that weakens the overall fiber fiber structure.

Exemplary of the products of the present invention are the following.

EXAMPLE 1

A continuous 1500 denier tow of KEVLAR-29, an aromatic polyamide, was stabilized pursuant to the process described in U.S. Pat. No. 4,642,664. The tow was knit on a circular knitting machine into a cloth having from 3 to 4 loops cm. The cloth was heat set at a temperature of 227° C. for a 20 minute period. When the cloth was deknitted, it produced a tow which had an elongation or reversible deflection ratio of greater than 2:1. The deknitted tow was cut into various lengths of from 5 to 25 cm, and fed into a Platts Shirley Analyzer. The fibers of the tow were separated by a carding treatment into a wool-like fluff in which the fibers had a high interstitial spacing and a high degree of interlocking as a result of the coiled configuration of the fibers. A similar result is achieved with KEVLAR-49 fibers.

EXAMPLE 2

An approximately 1500 denier tow of stabilized p-aramid fibers was knitted on a circular knitting machine at a rate of 4 stitches/cm and was then heat treated at a temperature of 425° C. in a nitrogen atmosphere for 10 minutes. The cloth was deknitted and the tow (which had an elongation or reversible deflection ratio of greater than 2:1) was cut. The cut tow was then carded on a Platt Miniature carding machine with the carbonaceous fibers of Pat. No. 4,869,951 produce a wool-like fluff.

The fluff may be densified by needle punching, treated with a thermoplastic binder such as a polyester binder, or the like, to form a mat or felt-like structure having fire resistance and good abrasion strength.

EXAMPLE 3

The wool-like fluff of Example 1 was fabricated into a thermal jacket employing about 200 g of the fluff as the sole filler for the jacket. The jacket had an insulating effect similar to that of a down (feather) jacket having from 425 to 710 g of down as the insulating fill. If desired, the fibers may be blended with other natural or polymeric linear or nonlinear fibers including, for example, nylon, rayon, polyester, cotton, wool, and the like, or carbonaceous non-graphitic fibers.

EXAMPLE 4

A circular knit fabric composed of non-stabilized p-aramid fibers was placed in a laboratory tube furnace under a nitrogen purge. The sample was heated to a temperature of 250° C. and held for 10 minutes. The sample was then cooled under nitrogen and removed. The fabric, when opened, contained fibers having a sinusoidal shape which were retained even though the fibers were stretched straight at ambient temperatures.

EXAMPLE 5

A 1500 denier tow of stabilized p-aramid fibers was crimped in a relaxed state while simultaneously heated to a temperature of 275° C. under a nitrogen purge. The heat treatment was conducted over a period of 10 minutes. When cooled the tow was opened. The fibers contained a heat set sinusoidal crimp which could not be removed by stretching the fiber or by heating with a conventional hair dryer.

EXAMPLE 6

The textile properties of various fiber samples of treated KEVLAR-29 were determined on an Instron Tensile Tester Series 4201 in lots of ten and the average result taken. The following settings were used:

Load Cell—"C"
Maximum Load—22.7 kg
Gauge Length—22.5 mm
Chart Speed—5 mm/min
Cross Head Speed—5 cm/min
Initial Mounting Tension—sufficient to straighten the yarn.
Temperature and Relative Humidity—70° C. and 65 percent.

The stress (tenacity) values at break were calculated by normalizing the load by denier (linear density) of the original yarn. The yarn linear density was found to be 1000.

Elongation (change in length) reading was given automatically on the digital readout of an Instron Tensile Tester. Extension (percent) at break was then calculated by change in length divided by gauge length multiplied by 100.

The values for each sample are shown in the following table I and illustrated in FIG. 1.

The samples prepared were

Fibers of the invention derived from KEVLAR-29 which were heat treated in air (K-29(air));
Fibers of the invention derived from KEVLAR-29 which were heat treated in nitrogen only (K-29($N_2$);
Fibers of the invention derived from KEVLAR-29 which were stabilized in air at 217° C. and then heat treated in a nitrogen atmosphere (K-29 stab→$N_2$).

The fibers had an amplitude of 2½ mm and three crimps per inch.

TABLE I

| Heat Treatment (°C.) | Tenacity (g/dn) K-29 (Air) | K-29 ($N_2$) | K-29 (Stab→$N_2$) |
|---|---|---|---|
| 20 (gear crimped virgin) | 16.76 | | |
| 20 (virgin)* | 27.84 | 28.84 | 27.84 |
| 125 | | | |
| 203 | | | |
| 207 | | 21.68 | |
| 213 | | | |
| 217 | 23.21 | | |
| 260 | | | |
| 270 | | | 23.16 |
| 305 | 22.87 | 19.92 | |
| 315 | | | 23.39 |
| 390 | | | |
| 402 | 14.21 | 16.46 | 16.75 |
| 417 | | | |
| 503 | | 6.64 | |
| 509 | 0.73 | | 6.75 |
| 522 | 1.55 | | |
| 605 | | | 0.25 |
| 610 | | | |

*non-heat treated

EXAMPLE 7

Following the procedure of Example 6, fibers of KEVLAR-49 are crimped. The results are shown in the following table II.

The nonlinear fibers of the invention had superior mechanical properties over nonlinear fibers which were mechanically crimped. A deterioration of the properties occurred sharply when the heat treatment temperature was raised above 500° C.

TABLE II

| Heat Treatment (°C.) | Tenacity (g/dn) K-49 (Air) | K-49 ($N_2$) | K-49 (Stab→$N_2$) |
|---|---|---|---|
| 20 (virgin)* | 25.11 | 25.11 | 25.11 |
| 125 | | | |
| 203 | | | |
| 207 | | | |
| 213 | 24.92 | | |
| 217 | 23.21 | | |
| 260 | | 17.29 | |
| 270 | | | |
| 305 | 18.33 | 18.84 | |
| 315 | | 21.57 | |
| 390 | | | |
| 402 | 11.53 | 13.26 | 14.51 |
| 417 | | | |
| 503 | | 9.65 | |
| 509 | 1.69 | | 5.15 |
| 522 | | | 1.09 |
| 605 | | | 0.25 |
| 610 | | | |

g/dn = grams/denier
*non-heat treated
Fibers heated above 525° C. were carbonaceous.

The invention which is intended to be protected herein, however, is not to be construed as limited to the particular embodiments disclosed, since these are to be regarded as illustrative. Variations and changes may be made by those skilled in the art without departing from the scope of invention.

What is claimed is:

1. A non-carbonaceous heat set aromatic polyamide fiber having a substantially permanent non-linear configuration at ambient temperatures with a reversible deflection ratio of greater than 1.2:1 at ambient temperatures, an aspect ratio of greater than 10:1, and a bending strain value less than about 50%, said fiber being substantially free of V-type crimps.

2. The fiber of claim 1, which has a tenacity of at least about 18 g/dn.

3. The fiber of claim 1 which has a bending strain value less than 30%.

4. The fiber of claim 1, which has a reversible deflection greater than 1.2:1 at a temperature in excess of 100° C.

5. The fiber of claim 1 wherein said non-linear configuration is substantially free of fibrils.

6. The fiber of claim 1 wherein said fiber has not more than a 15% variation from fiber diameter.

7. The fiber of claim 1, wherein said fiber is a p-aramid.

8. The fiber of claim 1 wherein said fiber is an oxidation stabilized aromatic polyamide.

9. The fiber of claim 1 which has been heat set substantially without tension.

10. A fibrous structure comprising a multiplicity of non-carbonaceous heat set aromatic polyamide fibers having a non-linear configuration at ambient temperatures, a substantially permanent reversible deflection ratio of greater than 1.2:1 at ambient temperature and an aspect ratio of greater than 10:1, said fibers having a bending strain value less than 50% and being substantially free of V-type crimps.

11. The fibrous structure of claim 10, wherein said fibers have a tenacity of at least about 18 g/dn.

12. The fibrous structure of claim 10, wherein said fibers have a reversible deflection greater than 1.2:1 at a temperature in excess of 100° C.

13. The fibrous structure of claim 10 wherein said fibers have a variation from fiber diameter of not more than 15%.

14. The fibrous structure of claim 10, wherein said fibers are derived from p-aramid.

15. The fibrous structure of claim 10, comprising a blend of said polyamide fibers with fibers selected from the group consisting of natural fibers, synthetic fibers and non-linear carbonaceous fibers.

16. The fibrous structure of claim 10, wherein said multiplicity of fibers are in the form of a tow, yarn, a wool-like mass of entangled fibers, a nonwoven batting, felt, web, or knitted or woven cloth or fabric.

* * * * *